US009075372B2

(12) United States Patent
Scrafford et al.

(10) Patent No.: US 9,075,372 B2
(45) Date of Patent: Jul. 7, 2015

(54) SYSTEMS AND METHODS FOR EMPLOYING A CUSTOMER REPLACEABLE UNIT (CRU) TO ALTER AN INSTALLATION TYPE FOR THE CRU IN AN IMAGE FORMING DEVICE

(71) Applicant: XEROX Corporation, Norwalk, CT (US)

(72) Inventors: Matthew O. Scrafford, Fairport, NY (US); Jason C. Tsongas, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 96 days.

(21) Appl. No.: 13/832,036

(22) Filed: Mar. 15, 2013

(65) Prior Publication Data

US 2014/0270812 A1 Sep. 18, 2014

(51) Int. Cl.
*G03G 15/00* (2006.01)
*G03G 21/18* (2006.01)

(52) U.S. Cl.
CPC ..... *G03G 15/5079* (2013.01); *G03G 21/1882* (2013.01); *G03G 2215/00109* (2013.01)

(58) Field of Classification Search
CPC ..... G03G 15/5079; G03G 21/1882; G03G 2215/00109
USPC ..... 399/8, 12, 13
See application file for complete search history.

(56) References Cited

U.S. PATENT DOCUMENTS 4,961,088 A * 10/1990 Gilliland et al. ..... 399/25
5,283,613 A * 2/1994 Midgley, Sr. ..... 399/9
6,016,409 A * 1/2000 Beard et al. ..... 399/33
6,173,128 B1 * 1/2001 Saber et al. ..... 399/24
6,351,621 B1 2/2002 Richards et al.
6,473,571 B1 * 10/2002 Wegman et al. ..... 399/12
6,494,562 B1 * 12/2002 Walker et al. ..... 347/32
6,629,134 B2 * 9/2003 Hayward et al. ..... 709/217
6,798,997 B1 * 9/2004 Hayward et al. ..... 399/12
6,940,613 B1 * 9/2005 Beard et al. ..... 358/1.13
6,947,964 B2 * 9/2005 Nishio ..... 709/202
6,985,877 B1 * 1/2006 Hayward et al. ..... 705/7.41
7,146,112 B2 * 12/2006 Phipps et al. ..... 399/12
7,307,531 B2 * 12/2007 Rommelmann et al. ... 340/572.1
7,529,491 B2 * 5/2009 Rommelmann et al. ..... 399/12
7,642,916 B2 * 1/2010 Phipps et al. ..... 340/572.7
8,014,012 B2 * 9/2011 Rodriguez et al. ..... 358/1.15
8,024,792 B2 * 9/2011 Zhang et al. ..... 726/19
8,035,831 B2 * 10/2011 Mathieson et al. ..... 358/1.15
8,090,273 B2 * 1/2012 Derimiggio ..... 399/12
8,125,666 B2 * 2/2012 Mathieson et al. ..... 358/1.15
(Continued)

*Primary Examiner* — David Bolduc
(74) *Attorney, Agent, or Firm* — Ronald E. Prass, Jr.; Prass LLP

(57) ABSTRACT

A system and method are provided for employing a customer replaceable unit (CRU) to modify its own installation type when installed in an image forming device, including an image forming device operated under a managed service contract. A database centric CRU inventory control architecture is provided for managing image forming device information through interactive communication with CRU monitoring modules (CRUMs) associated with CRUs installed in many and widely deployed image forming devices. The disclosed systems and methods make use of the CRUMs embedded in CRUs offered by a manufacturer or supplier along with a device management application offered by the manufacturer for on-site use by a customer to implement an inventory tracking and control system that reduces inventory overhead.

23 Claims, 4 Drawing Sheets

(56) References Cited

U.S. PATENT DOCUMENTS

| | | | | |
|---|---|---|---|---|
| 8,215,548 | B2 * | 7/2012 | Gnanasambandam et al. | 235/383 |
| 8,294,934 | B2 | 10/2012 | Reitz et al. | |
| 8,332,332 | B2 * | 12/2012 | Carlson et al. | 705/400 |
| 8,505,004 | B2 * | 8/2013 | Burke, Jr. | 717/173 |
| 8,542,376 | B2 * | 9/2013 | Carlson et al. | 358/1.14 |
| 8,614,821 | B2 * | 12/2013 | Burke et al. | 358/1.15 |
| 8,650,088 | B2 * | 2/2014 | VanWinckle et al. | 705/26.1 |
| 2002/0021909 | A1 * | 2/2002 | Harumoto | 399/27 |
| 2002/0075500 | A1 * | 6/2002 | Kurz et al. | 358/1.14 |
| 2002/0076223 | A1 * | 6/2002 | Kurz et al. | 399/12 |
| 2002/0076224 | A1 * | 6/2002 | Pollocks, Jr. | 399/12 |
| 2002/0076225 | A1 * | 6/2002 | Kurz et al. | 399/12 |
| 2002/0094207 | A1 * | 7/2002 | Richards et al. | 399/8 |
| 2002/0196463 | A1 * | 12/2002 | Schlonski et al. | 358/1.15 |
| 2003/0038958 | A1 * | 2/2003 | Salgado et al. | 358/1.11 |
| 2003/0058314 | A1 * | 3/2003 | Walker et al. | 347/86 |
| 2003/0123887 | A1 * | 7/2003 | Imes et al. | 399/24 |
| 2003/0215245 | A1 * | 11/2003 | Silence et al. | 399/8 |
| 2004/0090647 | A1 * | 5/2004 | Beard et al. | 358/1.14 |
| 2005/0036794 | A1 * | 2/2005 | Koontz et al. | 399/12 |
| 2005/0074246 | A1 * | 4/2005 | Hayward et al. | 399/8 |
| 2005/0141901 | A1 * | 6/2005 | Lee | 399/12 |
| 2005/0163514 | A1 * | 7/2005 | Hwang | 399/8 |
| 2006/0133828 | A1 * | 6/2006 | Rommelmann et al. | 399/8 |
| 2006/0133831 | A1 * | 6/2006 | Rommelmann et al. | 399/12 |
| 2006/0136989 | A1 * | 6/2006 | Rodriguez et al. | 726/2 |
| 2006/0178917 | A1 * | 8/2006 | Merriam et al. | 705/7 |
| 2007/0047974 | A1 * | 3/2007 | Tanaka | 399/8 |
| 2007/0047976 | A1 * | 3/2007 | Hamby et al. | 399/12 |
| 2007/0071459 | A1 * | 3/2007 | Nakazato | 399/12 |
| 2007/0146452 | A1 * | 6/2007 | Rodriguez et al. | 347/99 |
| 2007/0156628 | A1 * | 7/2007 | Rodriguez et al. | 707/1 |
| 2008/0181625 | A1 * | 7/2008 | Moodie et al. | 399/24 |
| 2008/0193147 | A1 * | 8/2008 | Beard et al. | 399/12 |
| 2008/0310070 | A1 * | 12/2008 | Wegman | 361/103 |
| 2009/0125317 | A1 * | 5/2009 | Meyer et al. | 705/1 |
| 2009/0309730 | A1 * | 12/2009 | Kothari et al. | 340/572.1 |
| 2010/0020147 | A1 * | 1/2010 | Rodriguez et al. | 347/88 |
| 2010/0309506 | A1 * | 12/2010 | Reitz et al. | 358/1.15 |
| 2010/0328050 | A1 * | 12/2010 | Kothari et al. | 340/10.51 |
| 2011/0188068 | A1 * | 8/2011 | Jones et al. | 358/1.15 |
| 2011/0191198 | A1 * | 8/2011 | Rise et al. | 705/26.1 |
| 2011/0191212 | A1 * | 8/2011 | Iburg et al. | 705/28 |
| 2012/0076515 | A1 * | 3/2012 | Rapkin et al. | 399/24 |
| 2012/0076517 | A1 * | 3/2012 | Rapkin et al. | 399/24 |
| 2012/0076518 | A1 * | 3/2012 | Rapkin et al. | 399/24 |
| 2012/0134686 | A1 * | 5/2012 | Jones et al. | 399/12 |
| 2012/0134687 | A1 * | 5/2012 | Jones et al. | 399/12 |
| 2012/0182574 | A1 * | 7/2012 | Kunihiro et al. | 358/1.15 |
| 2012/0254050 | A1 * | 10/2012 | Scrafford et al. | 705/318 |
| 2014/0082302 | A1 * | 3/2014 | Rommelmann et al. | 711/154 |

* cited by examiner

SYSTEMS AND METHODS FOR EMPLOYING A CUSTOMER REPLACEABLE UNIT (CRU) TO ALTER AN INSTALLATION TYPE FOR THE CRU IN AN IMAGE FORMING DEVICE

BACKGROUND

1. Field of the Disclosed Embodiments

This disclosure relates to systems and methods for employing a customer replaceable unit (CRU) to modify its own installation type when installed in an image forming device, including an image forming device operated under a managed service contract.

2. Related Art

Industries make extensive beneficial use of capabilities to track many characteristics that are associated with myriad CRUs in all manner devices and systems with which the CRUs are associated. Identification and monitoring of certain CRUs are functions that are often facilitated through the use of externally or remotely electronically-readable monitoring modules for identifying the CRUs and for monitoring one or more characteristics of the CRUs remotely. Monitored characteristics can include static information, i.e., information that does not change over the life of the CRU, such as a model or serial number and/or compatibility of the CRU with the system or device within which the CRU is installed. The monitoring module can also be used to record, in an electronically-readable format, dynamically changing information relating to a particular characteristic of the CRU. Such dynamic information includes, for example, information on use, maintenance, failures, diagnostics, remanufacture, and remaining service life, among other characteristics of the CRU. In the case of many devices, including and particularly managed devices that are operated by customers once they are fielded, information in and from the CRU is read by the customer's device and transmitted to a device or component manufacturer/supplier that is located remotely from the location in which the customer employs the device. Many industries have embraced the transition from local monitoring of CRUs via the electronically-readable monitoring modules to external and remote, particularly supplier-based or manufacturer-based, monitoring of CRUs at the customers' end-use sites. This change has allowed suppliers and manufacturers to independently monitor the status of CRUs for a number of reasons, including to facilitate correct billing and to attempt to avoid non-availability authorized and compatible CRUs at a point and time of need.

Examples of externally-monitorable systems or devices include various types of electronic office equipment, particularly image forming devices, such as those disclosed in, for example, U.S. Pat. No. 6,351,621 to Richards et al., which is commonly assigned and the disclosure of which is incorporated herein by reference in its entirety. Richards discloses CRUs, which routinely include electronically-readable monitoring chips containing static information for identification of the CRUs, and/or dynamic information relating to CRU operating status. Richards refers to such electronically-readable monitoring chips as customer replaceable unit monitors ("CRUMs"). Richards explains that, when an individual CRU is installed in the disclosed modularly designed office equipment, a communication interface is established locally with the CRUM as a component status monitoring module located within, or externally mounted to, a particular CRU. The CRUM enables the office equipment to monitor a characteristic of the CRU by reading data from, and potentially updating the information contained by writing data to, the monitoring module.

In image forming devices, systems for communicating with and/or remotely diagnosing the status of widely-dispersed devices are as well-known as they are in other technology areas. The image forming devices communicate via any manner of wired or wireless communication links with network interfaces such as, for example, via telephone lines, local area networks, and/or the Internet, in order to provide, for example, a remote supplier or manufacturer service center with access to the image forming device in order to read status and/or diagnostic information produced by the image forming device and components installed therein. Remote and widely dispersed access is thus implemented such that an operator, supplier, manufacturer, diagnostic technician or other individual whose duties may require access to information regarding the status of the image forming device, or of any replaceable component operating within the image forming device, can review the information that they need and potentially organize responsive actions for system maintenance and/or error correction or avoidance.

SUMMARY OF THE DISCLOSED EMBODIMENTS

As CRUM technology has matured in parallel with the maturation of an ability to communicate with CRUs from remote locations, manufacturers and/or suppliers have continued to seek ways to employ these advances to their benefit and to the benefit of their customers, particularly when it comes to system and/or supply support for the customers. For example, in instances where one or more CRU design or operating characteristics may vary over time due to manufacturing changes or to solve problems that may have been discovered post-launch with the image forming devices, the CRUs, or the interfaces between the two, CRU inventories may have to be modified. Configuration control and compatibility may be upset as inventories are broadened. Advantages may be found in communicating compatibility and configuration control to a particular image forming device via information in the CRUM associated with a particular CRU or via the remote communication interface with the manufacturer or supplier, or both. In addition to basic information identifying the CRU, additional information may be provided to confirm characteristics of the CRU when a reading device in a particular image forming device reads the CRUM.

The combinations of the above-discussed capabilities provide manufacturers and suppliers an ability to control configurations and to identify authorized CRUs in a manner that may promote customer compliance with managed service contracts while reducing the use of non-authorized and/or non-compliant counterfeit or copied CRUs in image forming devices. U.S. Patent Application Publication No. 2012/0254050 A1 to Scrafford et al., having overlapping inventorhip with this application and being co-assigned to the Assignee for this application, the disclosure of which is hereby incorporated by reference herein in its entirety, discloses a system and method for validating and tracking CRUs in an effort to address instances in the industry where it may be considered particularly advantageous to attempt to ensure that CRUs are authentic and that the CRUs meet device manufacturers' operational specifications. Scrafford et al. note that actions of copiers and counterfeiters, including reconfiguring or copying CRUMs, create significant problems affecting not only profits for the manufacturers and legitimate suppliers/resellers, but also brand reputation when customers become dissatisfied over product functionality risks and reduced image quality in particular image forming devices introduced through the use of non-compatible and/or unauthorized CRUs in the image forming devices.

U.S. Pat. No. 8,294,934 to Reitz et al., also having overlapping inventorhip with this application and being co-assigned to the Assignee for this application, the disclosure of which is hereby incorporated by reference herein in its entirety, provide a method that stores serial numbers in CRUMs such that when one or more CRUs are replaced in an image forming device, the image forming device is made to output to a computer the serial numbers of the CRUs that are replaced. Reitz et al. describe methods that use serial numbers to identify the specific image forming devices in which particular CRUs are used to track proper usage of CRUs in support of, for example, managed service contract compliance.

In implementing many of the above capabilities, CRU inventories and inventory management functions have expanded as CRUs may be individually added and catalogued according to combinations of some or all of the following: (1) product descriptions, e.g., toner bottle with toner of a particular color; (2) multiple associated device model numbers in which the CRUs may be employed; (3) operating areas or other characteristics of the image forming devices that receive the CRUs, e.g., a fuser module for use in the 110V version of device model X rather than the 220V version of device model A; (4) customer usage agreement classifications creating distinct classes of information to be captured for a particular category or sub-category of products; and (5) other like product discriminators and/or classifications. Of number (4) on the previous list, for example, a particular product CRU that is intended for use in image forming devices of a particular version of each of model numbers ABC, HIJ, and QRS, in a 110V configuration of those models, may be (a) supplied to a first group of customers at no additional cost under a managed service contract for the customers; (b) sold to a second group of contract customers at a contract price X that is negotiated with some customers that choose not to contract for managed services, but to otherwise contract for supplies; or (c) sold to open market customers at a separate price Y on an item-by-item basis.

It should be recognized that identification of a particular CRU according to each of these distinctions, while manageable, may have certain disadvantages for inventory control and record keeping. Currently, for example, different Stock-Keeping Units (SKUs) are created for each of the different types of CRUs needed by the customer in the field. For example, an open-market "sold" toner cartridge may have one (or more) SKUs associated with it, while a managed service contract enabled toner cartridge or another contract priced toner cartridge may have one or more other SKUs associated separately with it, i.e. for the same basic product, requiring the manufacturers to maintain many different configurations of an essentially-same CRU separated only according some non-operational characteristic such as billing distinctions.

It would be advantageous to advance the technologies described in Reitz et al. and in Scrafford et al. to combine a capacity for reading CRUMs at the time of shipment with a device management application at a customer site to identify a generic CRU at a point of installation in an image forming device to one or more beneficial purposes including reducing a number of SKUs without precipitating or requiring any reduction in the various types of functionalities and options offered to a customer.

Exemplary embodiments of the disclosed systems and methods may provide a database centric CRU inventory control architecture for managing image forming device information through interactive communication with CRUMs associated with CRUs installed in many and widely deployed image forming devices.

Exemplary embodiments may address a requirement in today's marketplace for many different SKUs for the available device CRUs. It is recognized that some CRUs may be offered in a sold configuration while others may be offered in a metered configuration expanding inventory and data tracking requirements. The disclosed systems and methods may make use of the CRUMs embedded in CRUs offered by a manufacturer or supplier along with a device management application offered by the manufacturer for on-site use by a customer to implement an inventory tracking and control system that reduces these numbers.

Exemplary embodiments of the disclosed schemes may provide that, upon shipment of a CRU, the CRUM value may be read by and stored in a service management database system at the manufacturer or supplier.

Exemplary embodiments may provide that the service management database system at the manufacturer or supplier may be used to distribute the appropriate read and stored CRUM values to a customer's compatible device management application.

Exemplary embodiments may provide that the received CRUM data may be used by the customer's device management application, upon insertion of a CRU in a particular image forming device, to modify the generic CRU to the intended use for the CRU.

Exemplary embodiments may supplement and streamline conventional inventory control and customer billing schemes by supplementing identification information for a particular CRU as it is modified at a point of installation in a particular image forming device and communicated back to the manufacturer or supplier.

Exemplary embodiments may address multiple potential usage scenarios in which certain billing agreements may be in place between a customer and the manufacturer/supplier changing a rate that is paid for particular CRUs to, for example, correctly bill the customer for the supplied CRUs. In scenarios in which no end user agreement is in place, no device management application will be in place. Purchases of CRUs "off the shelf" from a retailer may be largely unaffected by the disclosed schemes, except that a configuration of the CRU, upon insertion, may simply be changed to a sold supply and would be confirmed to function correctly in the image forming device in which the CRU is installed.

Exemplary embodiments may advantageously provide a novel streamlined manner by which to alter the SKU of manufacturer-supplied CRUs at an end user image forming device allowing for a lesser number of variant SKUs being maintained.

Exemplary embodiments may provide significant cost savings to a manufacturer by reducing a number of required variant SKUs.

Exemplary embodiments may provide increased customer satisfaction by avoiding inadvertent supply of a CRU with an incorrect SKU to a customer.

These and other features, and advantages, of the disclosed systems and methods are described in, or apparent from, the following detailed description of various exemplary embodiments.

BRIEF DESCRIPTION OF THE DRAWINGS

Various exemplary embodiments of the disclosed systems and methods for employing a CRU to modify its own installation type when installed in an image forming device, including an image forming device operated under a managed service contract, will be described, in detail, with reference to the following drawings, in which.

DETAILED DESCRIPTION OF THE DISCLOSED EMBODIMENTS

Figure 1:
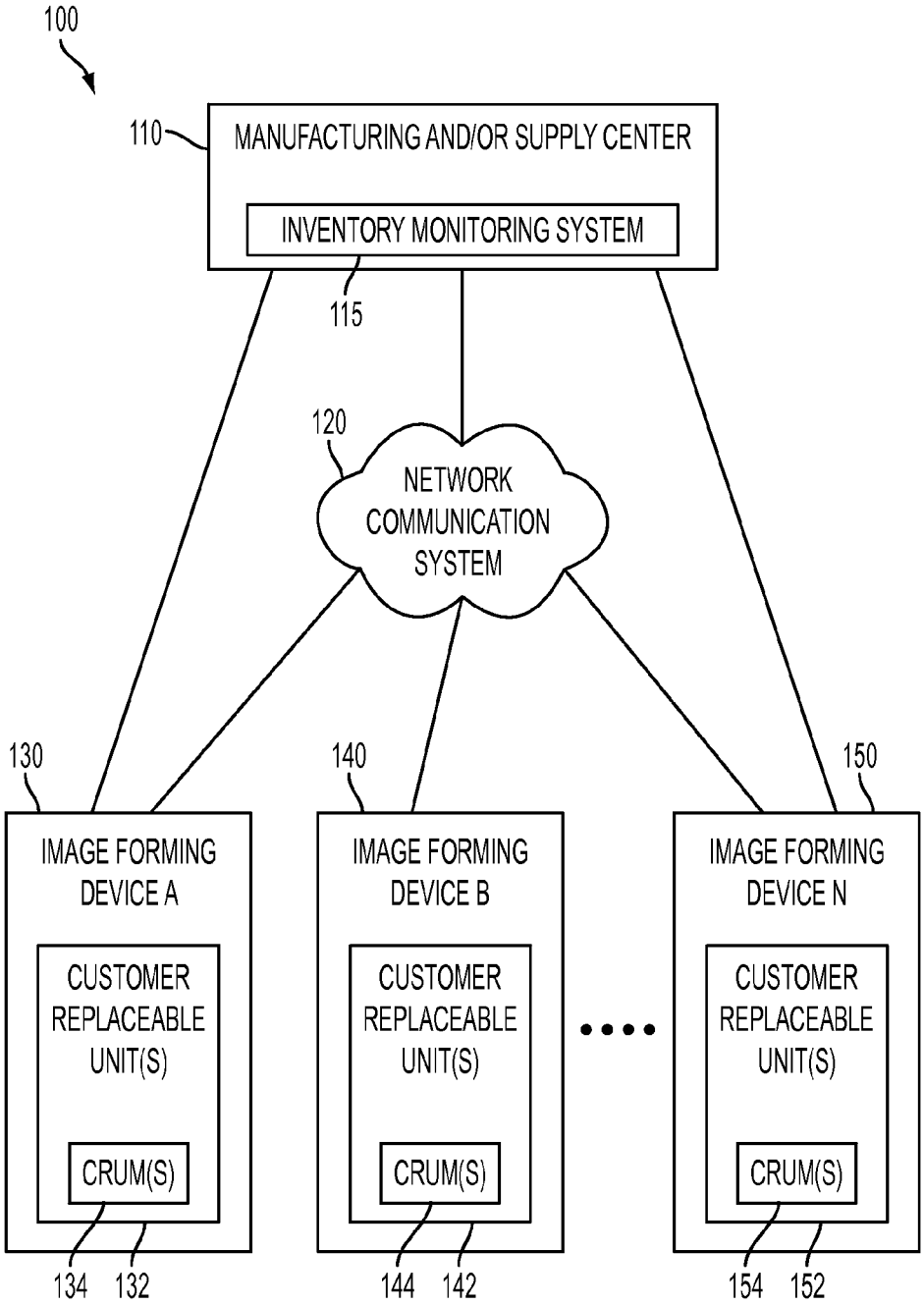
FIG. 1 illustrates a schematic diagram of an exemplary overview of networked communication system environment within which the systems and methods according to this disclosure may operate.

The systems and methods for employing a CRU to modify its own installation type when installed in an image forming device, including an image forming device operated under a managed service contract, according to this disclosure will generally refer to this specific utility for those systems and methods. Exemplary embodiments described and depicted in this disclosure should not be interpreted as being specifically limited to any particular configuration, or directed to any particular intended use. In fact, any monitoring and/or control of an electronically-readable component monitoring module via a support module provided for facilitating communication with a remote monitoring center/system that may change a configuration of a generic CRU once it installed in an image forming device and update a tracking and control inventory for that CRU, which may benefit from the systems and methods according to this disclosure, is contemplated.

Specific reference to, for example, any particular image forming device, including but not limited to any of a printer, copier, scanner, facsimile machine or multi-function device, should be understood as being exemplary only, and not limited, in any manner, to any particular class of such devices. The systems and methods according to this disclosure will be described as being particularly adaptable to use in printing and/or copying devices such as, for example, xerographic image forming devices for printing and/or copying, but should not be considered as being limited to only these types of devices. Any commonly known image forming device capable of wirelessly communicating with a remote computing/monitoring device via a network communication system that may be adapted according to the specific capabilities discussed in this disclosure is contemplated.

The disclosed embodiments may be advantageously operated in a networked communicating environment. A remote monitoring center/system, associated for example with a manufacturer or supplier, may be provided, the remote monitoring center/system being in communication with a plurality of image forming devices for communication with CRUMs associated with CRUs in those image forming devices to a number of beneficial purposes. These beneficial purposes may include compatibility management, contract enforcement and billing compliance, among others. The remote monitoring center/system may be centrally located at some extended distance from each of the plurality of image forming devices, and/or the customers' operating locations, in which multiple image forming devices may be housed and operated. The remote monitoring center/system may be configured to execute a number of monitoring functions and separately a number of control functions with regard to the plurality of image forming devices. Information regarding an identifier for a CRUM associated with a particular CRU and a particular destination device serial number may be maintained in a database associated with a service management database system under the control and/or oversight of a CRU supplier or manufacturer. This information may be shared, as appropriate, with a customer's device management application as may be appropriate for monitoring and control of a particular CRU in an individual image forming device within which the particular CRU is installed. This information may include one or more pieces of data that may be used to modify a generic CRU to an appropriate purpose in a manner that reduces a number of SKUs in an inventory maintained by the supplier or manufacturer.

FIG. 1 illustrates a schematic diagram of an exemplary overview of networked communication system environment 100 within which the systems and methods according to this disclosure may operate. As shown in FIG. 1, the exemplary networked communication system environment 100 may include at least one manufacturing and/or supply center 110 with which an inventory monitoring system 115 may be associated. The inventory monitoring system 115 may incorporate, for example, elements of a service management database system. The manufacturing and/or supply center 110 may communicate via the inventory monitoring system 115 with a plurality of fielded image forming devices A-N 130, 140, 150. The communications may be, for example, directly with the image forming devices A-N 130, 140, 150 via one or more direct communication links, or otherwise may be via any form of a network communication system 120. No particular architecture for the one or more communication links is to be implied by the depiction in FIG. 1.

The inventory monitoring system 115 may exercise some control over operations of the plurality of image forming devices A-N 130, 140, 150. This monitoring and control may advantageously assist customers, as the end-users of the image forming devices A-N 130, 140, 150, by allowing the CRU supplier or manufacturer to monitor and correct configuration control issues between the image forming devices A-N 130, 140, 150 and a number of CRUs 132, 142, 152 that are associated with the image forming devices A-N 130, 140, 150. The supplier or manufacturer, for example, may detect issues of non-compatibility between the CRUs 132, 142, 152 and the image forming devices A-N 130, 140, 150 and, where appropriate, update the compatibility or configuration information stored in the inventory monitoring system 115 via, for example, a customer's device management application. The monitoring and control may advantageously assist the supplier or manufacturer with contract enforcement in situations where the inventory monitoring system 115 may detect unauthorized, i.e., non-contractual, use of one or more of the image forming devices A-N 130, 140, 150, by monitoring information available regarding installed CRUs 132, 142, 152.

To effect the above objectives, also as shown in FIG. 1, each of the plurality of image forming devices A-N 130, 140, 150 may have associated with it respectively one or more CRUs 132, 142, 152. Although depicted in FIG. 1 as a single CRU 132, 142, 152 associated with each of the image forming devices A-N 130, 140, 150 for simplicity in depiction and ease of understanding, it should be recognized that an individual image forming device A-N 130, 140, 150 may have associated with it any number of CRUs 132, 142, 152. Further, many of the CRUs 132, 142, 152 may have associated with them respectively CRUMs 134, 144, 154. It is these respective CRUMs 134, 144, 154 that ultimately provide the mechanism by which the inventory monitoring system 115 is able to interact with individual components of the image forming devices A-N 130, 140, 150.

CRUMs 134, 144, 154 are provided to aid in identifying an individual respective CRU 132, 142, 152 to the individual image forming device A-N 130, 140, 150 within which the individual CRU 132, 142, 152 is installed. Configuration control and compatibility matching between an image forming device A-N 130, 140, 150 and a CRU 132, 142, 152 can be facilitated based on information written in the CRUM 134, 144, 154. The image forming devices A-N 130, 140, 150 may include a communication module that provides power to, and communicates directly with, the CRUMs 134, 144, 154, as part of the device management application. Once communication is established between the image forming devices A-N 130, 140, 150 and the CRUMs 134, 144, 154, updatable information regarding conditions of the image forming devices A-N 130, 140, 150 and the installed CRUs 132, 142, 152 may be exchanged with, and stored in, the CRUMs 134, 144, 154.

The above-described architecture may be employed to carry into effect a method for reducing a number of SKUs, for example by information exchange between the inventory monitoring system 115 maintaining a service management database at the manufacturer or supplier may exchange information with a customer's compatible device management application that may be hosted in components of the network communication system or in one or more of the image forming devices A-N 130, 140, 150. This structure may implement oversight to address the one or more of the following exemplary operating scenarios.

In a first exemplary operating scenario, customer or user A may have an image forming device, Device B, which needs a replacement toner cartridge CRU. Customer or user A is a managed service contract customer (e.g., a PagePack customer for Xerox®) for Device B only at its office. A manufacturer or supplier may dispatch a generic toner cartridge CRU with CRUM No. 12345 intended for Device B identified by a particular device serial number. At the time of shipment, the manufacturer's or supplier's service management database may be updated with the particular CRUM number identifier and the Device B serial number to identify the intended destination for the toner cartridge CRU. The inventory monitoring system 115 may cause the update stored in the manufacturer's or supplier's service management database to be forwarded to update customer or user A's device management application by, for example, setting the update in a queue for the next sync between the inventory monitoring system and customer or user A's device management application. Within standard shipping times, the sync occurs. When the generic toner cartridge CRU is inserted in Device B, communication with the device management application for customer or user A confirms that this toner cartridge CRU should be changed to and identified as a managed service contract variant. The change occurs immediately and the cartridge is rendered usable in Device B in the changed configuration. Return communication occurs back to the inventory management system 115 from the device management application of customer or user A to indicate that the toner cartridge CRU with CRUM No. 12345 is a managed service contract toner cartridge CRU and customer or user A is not billed separately for the toner cartridge CRU.

In a second exemplary operating scenario, customer or user A may have an image forming device, Device C, which needs a replacement toner cartridge CRU. Customer or user A is a managed service contract customer for Device C only at their office. The manufacturer or supplier may dispatch a generic toner cartridge CRU with CRUM No. 12345 intended for Device C identified by the device serial number. At the time of shipment, the manufacturer's or supplier's service management database may be updated with the particular CRUM identification number and the Device C serial number. The inventory monitoring system 115 may add the update for the customer or user A device management application to the queue for the next sync. Within standard shipping times, the sync occurs. When the generic toner cartridge CRU is inserted in Device D rather than Device C at the customer or user A site, communication with the device management application of customer or user A finds that Device D is not the intended destination for the toner cartridge CRU. The toner cartridge CRU may then be rejected with a message advising customer or user A of the serial number of the correct destination, Device C, being displayed to for customer or user A. Customer or user A may be presented with an option to be billed for this particular toner cartridge CRU identified with CRUM No. 12345 as a "sold" toner cartridge CRU, rather than a managed service contract toner cartridge CRU. Should customer or user A choose to accept the change in configuration, customer or user A may take appropriate action and the generic toner cartridge CRU may be defined as a "sold" toner cartridge CRU, the device management application of customer or user A may be updated with the information, the reconfigured toner cartridge CRU functions properly and customer or user A is billed appropriately. Return communication back to the inventory control system 115 from the device management application of customer or user A indicates that the toner cartridge CRU with CRUM No. 12345 is not being employed in the intended destination device, Device C, and therefore falls outside the managed service contract. As a result, customer or user A is billed for the toner cartridge CRU at the agreed upon price.

In a third exemplary operating scenario, customer or user E may have an image forming device, Device F, which needs a replacement toner cartridge CRU. Customer or user E may be a corporate customer, which entitles customer or user E to special pricing for the authorized toner cartridge CRUs that it may order from a manufacturer or supplier. The manufacturer or supplier may dispatch a generic toner cartridge CRU with CRUM No. 54321 intended for Device F identified by the device serial number. At the time of shipment, the manufacturer's or supplier's service management database may be updated with the particular CRUM identification number and the Device D serial number to identify the intended destination for the toner cartridge CRU. The inventory management system 115 may add the update for customer or user E's device management application to the queue for the next sync. Within standard shipping times, the sync occurs. When the generic toner cartridge CRU is inserted in Device F, communication with the device management application of customer or user E confirms that this toner cartridge CRU should be changed to a "sold" variant. The change occurs immediately and the toner cartridge CRU is rendered usable in Device F in that configuration. Return communication occurs back to the inventory management system 115 from the device management application of customer or user E that the toner cartridge CRU with CRUM No. 54321 is a sold cartridge and customer or user E is billed for the cartridge at the agreed upon price.

In a fourth exemplary operating scenario, customer or user E may have an image forming device, Device G, which needs a replacement toner cartridge CRU. Customer or user E is a corporate customer which entitles them to special pricing for the authorized toner cartridge CRUs that they order from the manufacturer or supplier. The manufacturer or supplier may dispatch a generic toner cartridge CRU with CRUM No. 54321 intended for Device G identified by the device serial number. At the time of shipment, the manufacturer's or supplier's service management database may be updated with the particular CRUM identification number and the Device G serial number. The inventory control system 115 may add the update for customer or user E device management application to the queue for the next sync. Within standard shipping times, the sync occurs. When the generic toner cartridge CRU is inserted in Device H, communication with the local device management application of customer or user B may see the device that the toner cartridge CRU was inserted in, Device H, which differs from the intended destination device, Device G. Because Device H is also shown as within the fleet of customer or user E, the toner cartridge CRU may be changed to a "sold" toner cartridge CRU and function correctly. An update is sent back to the inventory control system 115 for the destination information. The return communication occurs back to the inventory management system 115 from the device management application of customer or user E that the cartridge with CRUM No. 54321 is a contract priced toner cartridge CRU and customer or user E is billed for the toner cartridge CRU at the agreed upon price.

In a fifth exemplary operating scenario, customer or user E may have an image forming device, Device J, which needs a replacement toner cartridge CRU. Customer or user E is a corporate customer, which entitles them to special pricing for the authorized toner cartridge CRUs that they order from a manufacturer or supplier. The manufacturer or supplier dispatches a generic toner cartridge CRU with CRUM No. 54321 intended for Device J identified by the device serial number. At the time of shipment, the manufacturer's or supplier's service manager database may be updated with the particular CRUM identification number and the Device J serial number to identify the intended destination for the toner cartridge CRU. The inventory monitoring system 115 may add the update for customer or user E device management application to the queue for the next sync. Within standard shipping times, the sync occurs. When the generic toner cartridge CRU is inserted in Device K, communication with the device management application of customer or user E sees the device in which the toner cartridge CRU was inserted in differs from the intended destination. Device K is not shown as within the fleet of customer or user E. Depending on the agreement in place with customer or user E, the toner cartridge CRU may either be rejected, or customer or user E may be billed at some specified different rate for that toner cartridge CRU.

All of these scenarios assume there is a billing agreement in place with the customer or user A (or E) changing a rate that is paid for the toner cartridge CRUs according to conditions of the agreement. If a customer or user has no agreement in place, no device management application will be in place. In such a situation, purchases of toner cartridge CRUs off the shelf from a retailer would have no effect on a particular customer or user use of the toner cartridge CRU. The toner cartridge CRU may, on insertion, simply change to a configuration of the toner cartridge CRU to a sold configuration and may be rendered to function correctly in the image forming device.

It should be recognized that the above-described exemplary scenarios provide an approximate cross section of the operating scenarios in which the systems and methods according to this disclosure may be beneficially employed. The above descriptions are not intended to imply that these are the only operating scenarios for the disclosed systems and methods.

Figure 2:
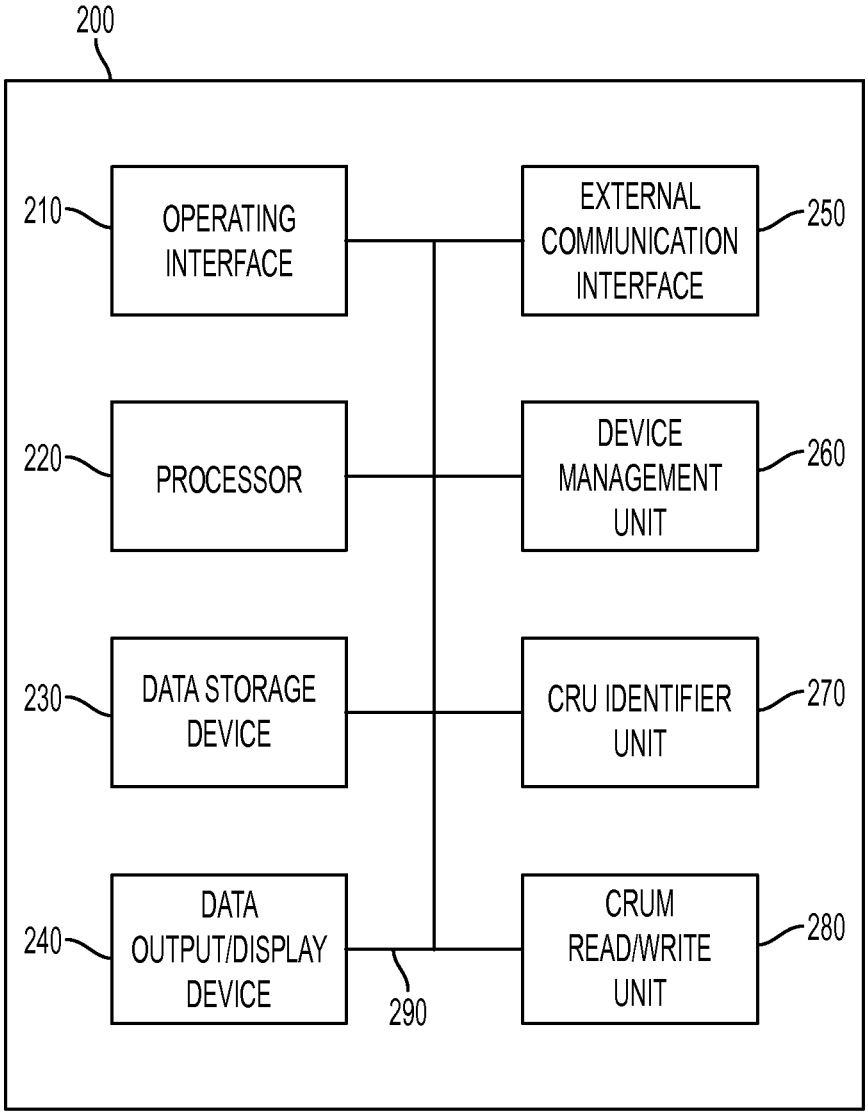
FIG. 2 illustrates a block diagram of an exemplary system for hosting a customer-based device management application that communicates with a supplier service management database system to execute monitoring and control functions over one or more image forming devices according to this disclosure.

FIG. 2 illustrates a block diagram of an exemplary system 200 for hosting a customer-based device management application that communicates with a supplier service management database system to execute monitoring and control functions over one or more image forming devices according to this disclosure. The exemplary system 200 shown in FIG. 2 may be, for example, housed at a user location in a server or in one or more of the imaged forming devices that may be networked together to be managed by the device management application.

The exemplary system 200 may include an operating interface 210 by which a user may communicate with the exemplary system 200, or otherwise by which the exemplary system 200 may receive instructions input to it from another source. In instances where the operating interface 210 may be a locally accessible user interface, the operating interface 210 may be configured as one or more conventional mechanisms common to computing and/or image forming devices that permit a user to input information to the exemplary system 200. The operating interface 210 may include, for example, a conventional keyboard and mouse, a touchscreen with "soft" buttons or with various components for use with a compatible stylus, a microphone by which a user may provide oral commands to the exemplary system 200 to be "translated" by a voice recognition program, or other like device by which a user may communicate specific operating instructions to the exemplary system 200.

The exemplary system 200 may include one or more local processors 220 for individually operating the exemplary system 200 and for carrying out data collection, processing, assessment and control functions. Processor(s) 220 may include at least one conventional processor or microprocessor that interprets and executes instructions to direct specific data collection, monitoring and storage functions with regard to a specific image forming device, or a plurality of image forming devices overseen by the device management application. Processor(s) 220 may initiate and control of certain data collection, analysis and reconfiguration efforts of the exemplary system 200, or may otherwise direct an update, for example, to the information stored in a CRUM and/or stored in an inventory monitoring system at a remote location, as shown in FIG. 1.

The exemplary system 200 may include one or more data storage devices 230. Such data storage device(s) 230 may be used to store data or operating programs to be used by the exemplary system 200, and specifically the processor(s) 220. Data storage device(s) 230 may be used to collect information regarding any or all of the functions of the exemplary system 200, as described above. The data storage device(s) 230 may include a random access memory (RAM) or another type of dynamic storage device that is capable of storing collected information, and separately storing instructions for execution of system operations by, for example, processor(s) 220. Data storage device(s) 230 may also include a read-only memory (ROM), which may include a conventional ROM device or another type of static storage device that stores static information and instructions for processor(s) 220. Further, the data storage device(s) 230 may be integral to the exemplary system 200, or may be provided external to, and in wired or wireless communication with, the exemplary system 200.

The exemplary system 200 may include at least one data output/display device 240 which may be configured as one or more conventional mechanisms that output information to a user, including a display screen on a computing or image forming device, including a graphical user interface (GUI) on the image forming device. The data output/display device 240 may be usable to display to a user an indication of a reconfiguration of a generic CRU when installed in the device and/or information regarding a detected discrepancy between information, for example, stored in a CRUM associated with the CRU and information that has been transferred to the device management application from the service management database of the inventory monitoring system as shown in FIG. 1. The data output/display device 240 may provide the user with an option to provide a manual input regarding a reconfiguration of the installed CRU in an effort to resolve the detected discrepancy as discussed and described in the exemplary operating scenarios outlined above.

The exemplary system 200 may include one or more separate external communication interfaces 250 by which the exemplary system 200 may communicate with components external to the exemplary system 200, such as the inventory monitoring system as shown in FIG. 1. Principal external data communication to the inventory monitoring system for the exemplary system 200 will generally be via at least one external communication interface 250 configured specifically to facilitate communication with the inventory monitoring system according to any one or more of available communication links for sharing information with, and updating information stored in, the inventory monitoring system. No particular limiting configuration to the external communication interface 250 is to be implied by the depiction in FIG. 2, other than that the external communication interface 250 may be configured to connect to the one or more available communication links.

The exemplary system 200 may include a device management unit 260, which may be a part or a function of processor 220 coupled to, for example, one or more storage devices 230, or may be a separate stand-alone component module or circuit in the exemplary system 200. The device management unit 260 may be provided to the user by a manufacturer or supplier of the one or more image forming devices that the device management unit 260 is intended to oversee. The device management unit 260 may be operated to effect the communications and CRU configuration modification schemes described above.

The exemplary system 200 may include at least a CRU identifier unit 270. The CRU identifier unit 270 may establish communications with one or more CRUMs associated with one or more newly-installed CRUs in at least one of the plurality of image forming devices via, for example, a CRUM read/write unit 280. Once communications are established with the CRUM, information may be read from the CRUM by the CRUM read/write unit 280 as the manner by which the newly-installed CRU may be identified to the image forming device within which the CRU is installed for use. The CRU identifier unit 270 may then communicate directly with the device management unit 260 to compare information read from the CRUM with information that was forwarded from the inventory monitoring system to the device management unit 260 by a supplier or manufacturer of the CRU at the same time that the CRU was shipped to the customer for installation in the image forming device identified as a destination for that particular CRU. In instances when the CRU is determined, according to the above information comparison, to have been installed properly in the indicated destination image forming device, a billing identifier for the CRU may be modified and that information may be forwarded via the external communication interface 250 to the inventory monitoring system. In this manner, information specific to that CRUM, identified by its unique identifier, and moreover to the CRU with which the CRUM is associated, may be modified and provided to the inventory monitoring system. Regular crosstalk between the device management application in the device management unit 260 with the supplier service management database in the inventory monitoring will ensure that the information recorded in the CRUM is the same as information recorded according to that CRUMs identifier in the supplier service management database. When data mismatch is detected, such information may be communicated to and from the exemplary system 200 for resolution.

All of the various components of the exemplary system 200, as depicted in FIG. 2, may be connected by one or more data/control busses 290. These data/control busses 290 may provide wired or wireless communication between the various components of the exemplary system 200, whether all of those components are housed integrally in, or are otherwise external and connected to, the exemplary system 200.

It should be appreciated that, although depicted in FIG. 2 as an integral unit, the various disclosed elements of the exemplary system 200 may be arranged in any combination of sub-systems as individual components or combinations of components, integral to a single unit, or external to, and in wired or wireless communication with the single unit of the exemplary system 200. In other words, no specific configuration as an integral unit or as a support unit is to be implied by the depiction in FIG. 2. Further, although depicted as individual units for ease of understanding of the details provided in this disclosure regarding the exemplary system 200, it should be understood that the described functions of any of the individually-depicted components may be undertaken, for example, by one or more processors 220 connected to, and in communication with, one or more data storage devices 230.

Figure 3:
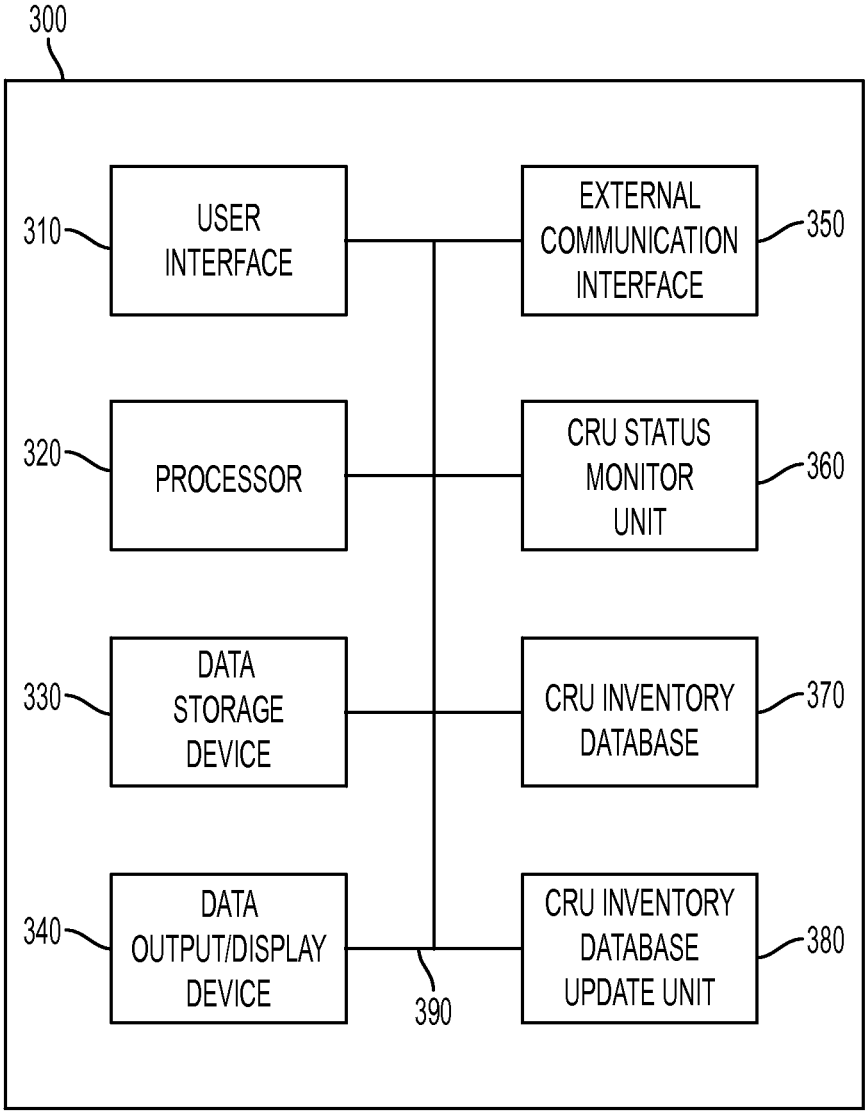
FIG. 3 illustrates a block diagram of an exemplary supplier service management database system associated with a remote manufacturing and supply center according to this disclosure.

FIG. 3 illustrates a block diagram of an exemplary system 300 for hosting a supplier service management database associated with a remote manufacturing and supply center according to this disclosure. The exemplary system 300 shown in FIG. 3 may be embodied in a particular inventory monitoring system in a manufacturing or supply center.

The exemplary system 300 may include a user interface 310 by which the user may communicate with the exemplary system 300. The user interface 310 may be configured according to any one or more of the conventional mechanisms described above with reference to operating interface 210 shown in FIG. 2.

The exemplary system 300 may include one or more local processors 320 for individually operating the exemplary system 300 and carrying out the interaction between the supplier service management database and the one or more device management applications deployed at the various customer sites Again here, processor(s) 320 may include at least one conventional processor or microprocessor that interprets and executes instructions for communication and interaction with the locally-stored database and downstream device management applications.

The exemplary system 300 may include one or more data storage devices 330. Such data storage device(s) 330 may be used to store data or operating programs to be used by the exemplary system 300, and specifically the processor(s) 320. At least one data storage device 330 will act as a queue for temporary storage of CRUM data to be forwarded to the one or more customer device management applications for comparing with the information recorded on the physical CRUM installed in a downstream image forming device with information that was stored in the service management database before the CRU with which the CRUM is associated was forwarded to the customer for use. Data storage device(s) 330 may be the same types of storage devices outlined above with regard to the exemplary system 200 depicted in FIG. 2.

The exemplary system 300 may include a data output/display device 340. In this instance, the data output/display device 340 may be of like configurations to those described above.

The exemplary system 300 may include one or more external communication interfaces 350. Here, however, the individual external communication interfaces 350 of the exemplary system 300 will be directed at communicating via various available communication links with the with customer device management applications, and ultimately communicating with one or more CRUMs associated with separate CRUs in the image forming devices via a CRU status monitor unit 360. As indicated above, processor(s) 320 in the exemplary system 300 may act as a communication path between the inventory monitoring systems and CRU status monitor unit 360 with an objective of ensuring that information associated with the unique CRUM identifier is maintained to be identical between the CRUM and the CRU inventory database 370 (as a supplier service management database). The CRU inventory database 370 may receive information regarding a CRUM identifier and an expected destination device for the CRU with which the identified CRUM is associated by use of the CRU inventory database update unit 380 before the CRU is deployed to the customer for installation and use in one or more image forming devices. Information flowing back from the device management application overseen by the customer may be received in the exemplary system 300 via the external communication interface 350 and applied as a change to the stored service management database in the CRU inventory database 370, the update occurring automatically via interpretation of the received information through the CRU inventory database update unit 380.

As with the exemplary system 200 shown in FIG. 2, all of the various components of the exemplary system 300, as depicted in FIG. 3, may be connected by one or more data/control busses 390. These data/control busses 390 may provide wired or wireless communication between the various components of the exemplary system 300, as all of those components are intended to be housed integrally in a single device.

It should be appreciated that, although depicted in FIG. 3 as an integral unit, the various disclosed elements of the exemplary system 300 may be arranged in any combination of sub-systems as individual components or combinations of components, integral to a single unit, or as components of the image forming device with which the exemplary system 300 is associated. No specific configuration is to be implied by the depiction in FIG. 3.

Figure 4:
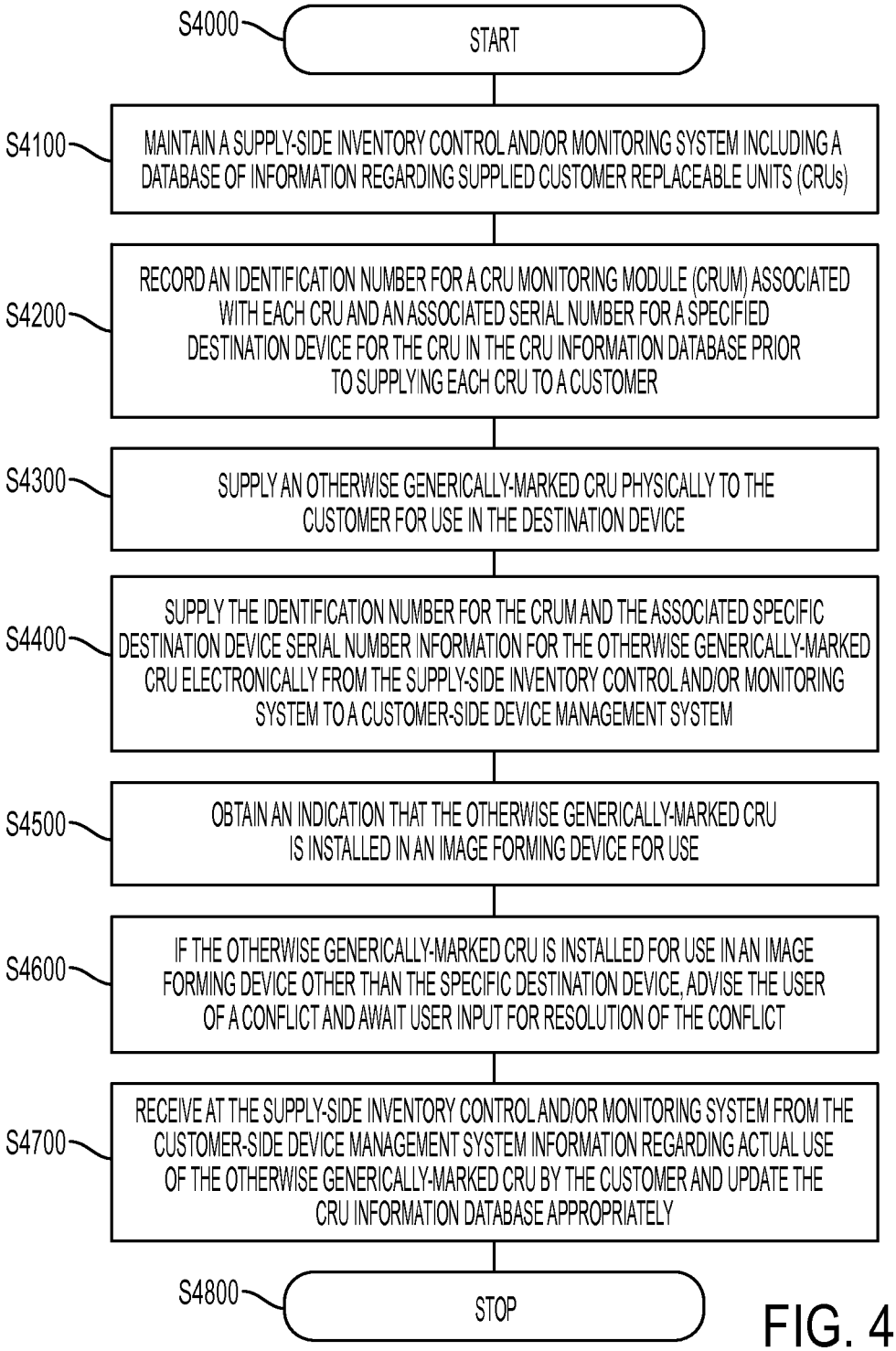
FIG. 4 illustrates a flowchart of an exemplary method for interacting with a CRUM for modifying a CRU in an image forming device according to this disclosure.

The disclosed embodiments may include an exemplary method for interacting with a CRUM for modifying a CRU in an image forming device through coordinated communication between a supplier service management database and a plurality of customer device management applications. FIG. 4 illustrates a flowchart of such an exemplary method. As shown in FIG. 4, operation of the method commences at Step S4000 and proceeds to Step S4100.

In Step S4100, a supply-side inventory control and/or monitoring system including a database of information regarding supplied CRUs may be generated and maintained as a body of information regarding a CRU that may be stored in the CRUM for that CRU. Operation of the method proceeds to Step S4200.

In Step S4200, an identification number for a CRUM associated with each CRU and an associated serial number for a specified destination device for the CRU may be recorded in the CRU information database prior to supplying each CRU to a customer. Operation of the method proceeds to Step S4300.

In Step S4300, an otherwise generically-marked CRU may be physically supplied or simply shipped to the customer for use in the identified destination device. Operation of the method proceeds to Step S4400.

In Step S4400, the identification number for the CRUM and the associated specific destination device serial number information for the otherwise generically-marked CRU may be electronically supplied from the supply-side inventory control and/or monitoring system to a customer-side device management application or system. Operation of the method proceeds to Step S4500.

In Step S4500, an otherwise generically-marked CRU may be installed in an image forming device for use. Upon insertion/installation of the CRU in the image forming device, an indication that the otherwise generically-marked CRU is installed in the image forming device may be obtained. Operation of the method proceeds to Step S4600.

In Step S4600, if the otherwise generically-marked CRU is installed for use in an image forming device other than the specific destination device, a user of the image forming device may be advised of a conflict and await user input for resolution of the conflict. Operation of the method proceeds to Step S4700.

In Step S4700, the supply-side inventory control and/or monitoring system may obtain from the customer-side device management system information regarding actual use of the otherwise generically-marked CRU by the customer and may update the CRU information database appropriately based on a reconfiguring of the CRU for use by one of the destination image forming device or the customer-side device management system. Operation of the method proceeds to Step S4800, where operation of the method ceases.

The disclosed embodiments may include a non-transitory computer-readable medium storing instructions which, when executed by a processor, may cause the processor to execute all, or at least some, of the steps of the method outlined above.

The above-described exemplary systems and methods reference certain conventional components to provide a brief, general description of suitable communication and processing environments in which the subject matter of this disclosure may be implemented for familiarity and ease of understanding. Although not required, embodiments of the disclosure may be provided, at least in part, in a form of hardware circuits, firmware, or software computer-executable instructions to carry out the specific functions described. These may include individual program modules executed by a processor. Generally, program modules include routine programs, objects, components, data structures, and the like that perform particular tasks or implement particular data types in support of the overall objective of the systems and methods according to this disclosure.

Those skilled in the art will appreciate that other embodiments of the disclosed subject matter may be practiced in data computing and communicating network environments with many types of communication equipment and computer system configurations. Embodiments according to this disclosure may be practiced in distributed computing and communicating environments where tasks are performed by local and remote actual and virtualized processing devices that may be linked to each other by hardwired links, wireless links, or a combination of both through a communication network. In a distributed computing/communicating environment, program modules may be located in both local and remote memory storage devices.

As indicated above, embodiments within the scope of this disclosure may also include computer-readable media having stored computer-executable instructions or data structures that can be accessed, read and executed by one or more processors. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures. When information is transferred or provided over a network or another communications connection, whether wired, wireless, or in some combination of the two, the receiving processor properly views the connection as a computer-readable medium. Thus, any such connection is properly termed a computer-readable medium. Combinations of the above should also be included within the scope of the computer-readable media for the purposes of this disclosure.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represents one example of a corresponding sequence of acts for implementing the functions described in the steps. The exemplary depicted steps may be executed in any reasonable order to effect the objectives of the disclosed embodiments. No particular order to the disclosed steps of the method is necessarily implied by the depiction in FIG. 4, except where a particular method step is a necessary precondition to execution of any other method step.

Although the above description may contain specific details, they should not be construed as limiting the claims in any way. Other configurations of the described embodiments of the disclosed systems and methods are part of the scope of this disclosure. For example, the principles of the disclosure may be applied to each individual image forming device of a plurality of image forming devices operated by numerous customers at specific customer sites where individual image forming devices or groups of the image forming devices have associated with them device management applications for communication with a manufacturer or supplier inventory control database system. Each image forming device may include some portion of the disclosed system and execute some portion of the disclosed method but not necessarily all of the system components or method steps.

It will be appreciated that various of the above-disclosed and other features and functions, or alternatives thereof, may be desirably combined into many other different systems or applications. Also, various alternatives, modifications, variations or improvements therein may be subsequently made by those skilled in the art which are also intended to be encompassed by the following claims.

We claim:

1. A method to identify a replaceable component in a device, comprising:

receiving, with a processor in the device, replaceable component identifying information from a supplier, the processor in the device running a device management application associated with the device, the received replaceable component identifying information comprising an identification number for a replaceable component shipped by the supplier and an associated serial number for an intended destination device for the replaceable component;

comparing, with the processor running the device management application in the device, the received replaceable component identifying information with information read directly from an electronic monitoring module associated with the replaceable component, the information being read directly from the electronic monitoring module when the replaceable component is installed in the device for use;

assigning, with the processor running the device management application in the device, additional identifying information to the replaceable component using the device management application; and transmitting the additional identifying information for the replaceable component to the supplier.

2. The method of claim 1, the replaceable component being identified only with an identification number for the replaceable component and an intended destination device serial number recorded in the electronic monitoring module associated with the replaceable component when the replaceable component is shipped from the supplier.

3. The method of claim 1, the assigning the additional information to the replaceable component comprising providing required configuration information to configure the replaceable component for use in the device.

4. The method of claim 1, the assigning the additional information to the replaceable component comprising providing billing information associated with the replaceable component.

5. The method of claim 1, the replaceable component identifying information being recorded in a supplier database at a time of shipping of the replaceable component.

6. The method of claim 5, the supplier database being updated with the additional information transmitted to the supplier.

7. The method of claim 1, the comparing the received replaceable component identifying information with information read directly from the electronic monitoring module associated with the replaceable component further comprising determining whether the device in which the replaceable component is installed is the intended destination device based on a comparison of serial numbers for the device in which the replaceable component is installed and the intended destination device by the device management application.

8. The method of claim 7, further comprising providing a user of the device with options for resolving a conflict that arises when it is determined that the device in which the replaceable component is installed is not the intended destination device.

9. The method of claim 8, the assigning the additional information to the replaceable component comprising providing first billing information associated with the replaceable component when it is determined that the device in which the replaceable component is installed is the intended destination device and providing separate second billing information associated with the replaceable component when it is determined that the device in which the replaceable component is installed is not the intended destination device.

10. The method of claim 9, the first billing information being associated with a contractual agreement between the supplier and a customer to whom the replaceable component was shipped and the second billing information being a market price for the replaceable component falling outside the contractual agreement.

11. The method of claim 8, further comprising disabling the device in which the replaceable component is installed when the conflict is not resolved by the user.

12. A system for identifying a replaceable component in a device, comprising:

an external communication interface for receiving replaceable component identifying information from a supplier, the received replaceable component identifying information comprising an identification number for a replaceable component shipped by the supplier and an associated serial number for an intended destination device for the replaceable component; and a processor that is programmed to run a device management application associated with at least one device in which the replaceable component is installed, the device management application comparing the received replaceable component identifying information with information read directly from an electronic monitoring module associated with the replaceable component, the information being read directly from the electronic monitoring module when the replaceable component is installed in the at least one device; and assigning additional identifying information to the replaceable component; and the external communication interface transmitting the additional identifying information for the replaceable component assigned by the device management application to the supplier.

13. The system of claim 12, the replaceable component being identified only with an identification number for the replaceable component and an intended destination device serial number recorded in the electronic monitoring module associated with the replaceable component when the replaceable component is shipped from the supplier.

14. The system of claim 12, the assigning the additional information to the replaceable component comprising providing required configuration information to configure the replaceable component for use in the device.

15. The system of claim 12, the assigning the additional information to the replaceable component comprising providing billing information associated with the replaceable component.

16. The system of claim 12, the replaceable component identifying information being recorded in a supplier database at a time of shipping of the replaceable component and the supplier database being updated with the additional information transmitted to the supplier.

17. The system of claim 12, the comparing the received replaceable component identifying information with information read directly from the electronic monitoring module associated with the replaceable component further comprising determining whether the device in which the replaceable component is installed is the intended destination device based on a comparison of serial numbers for the device in which the replaceable component is installed and the intended destination device.

18. The system of claim 17, further comprising an operating interface on which is displayed one or more options for user inputs to be received from a user of the device to resolve a conflict that arises when it is determined that the device in which the replaceable component is installed is not the intended destination device.

19. The system of claim 18, the assigning the additional information to the replaceable component comprising providing first billing information associated with the replaceable component when it is determined that the device in which the replaceable component is installed is the intended destination device and providing separate second billing information associated with the replaceable component when it is determined that the device in which the replaceable component is installed is not the intended destination device.

20. The system of claim 19, the first billing information being associated with a contractual agreement between the supplier and the user and the second billing information being a market price for the replaceable component falling outside the contractual agreement.

21. The system of claim 18, the processor being further programmed to disable the device in which the replaceable component is installed when the conflict is not resolved by the user.

22. The system of claim 12, the device being an image forming device.

23. A non-transitory computer readable medium storing executable instructions recorded that, when executed by a processor in a device, cause the processor to execute steps of a method to identify a replaceable component in the device, the method comprising:

executing a device management application to compare replaceable component identifying information with information read directly from an electronic monitoring module associated with the replaceable component, the information being read directly from the electronic monitoring module when the replaceable component is installed in the device, the replaceable component identifying information being received from a supplier and comprising an identification number for a replaceable component shipped by the supplier and an associated serial number for an intended destination device for the replaceable component;

assigning additional identifying information to the replaceable component using the device management application; and transmitting the additional identifying information for the replaceable component to the supplier.

* * * * *